US008671954B2

(12) United States Patent
Conn

(10) Patent No.: US 8,671,954 B2
(45) Date of Patent: Mar. 18, 2014

(54) HAIR COLOURING TOOL AND METHOD OF USE

(76) Inventor: Nicholas William Conn, Surrey (CA)

( * ) Notice: Subject to any disclaimer, the term of this patent is extended or adjusted under 35 U.S.C. 154(b) by 0 days.

(21) Appl. No.: 13/097,340

(22) Filed: Apr. 29, 2011

(65) Prior Publication Data

US 2011/0265808 A1 Nov. 3, 2011

Related U.S. Application Data

(60) Provisional application No. 61/329,815, filed on Apr. 30, 2010.

(51) Int. Cl.
*A45D 24/22* (2006.01)

(52) U.S. Cl.
USPC ..... 132/114

(58) Field of Classification Search
USPC ..... 132/112–116, 202, 207, 270; 222/192, 222/386; 401/287–288, 291
See application file for complete search history.

(56) References Cited

U.S. PATENT DOCUMENTS 945,474 A * 1/1910 Parnham ..... 222/326
1,397,510 A * 11/1921 Grassi ..... 425/376.1
2,889,699 A * 6/1959 Ames ..... 425/87
3,107,388 A * 10/1963 Groves ..... 401/183
4,408,919 A * 10/1983 Wolff et al. ..... 401/12
4,462,413 A * 7/1984 Schmitz ..... 132/113
4,664,611 A * 5/1987 Kumar ..... 425/87
5,059,050 A * 10/1991 Guglielmo ..... 401/171
5,060,679 A * 10/1991 Christopher et al. ..... 132/114
5,139,488 A * 8/1992 Klein ..... 604/184
5,333,627 A * 8/1994 Mehringer et al. ..... 132/108
5,913,314 A * 6/1999 Garrett ..... 132/112
7,934,512 B2 * 5/2011 Spagnuolo ..... 132/112
8,220,469 B1 * 7/2012 Spagnuolo ..... 132/114

* cited by examiner

*Primary Examiner* — Robyn Doan
*Assistant Examiner* — Jennifer Gill
(74) *Attorney, Agent, or Firm* — Tomlinson Rust McKinstry Grable

(57) ABSTRACT

A hair coloring tool which includes a body which has an opening and interior walls that define an interior cavity for containing a fluid hair colorant. At least one dispensing structure is provided on the body which is in fluid communication with the interior cavity. A plunger is pivotally connected to the body. The plunger is removably positioned in the opening of the interior cavity and is in sealing engagement with the interior walls of the interior cavity such that upon manual depression of the plunger, fluid hair colorant is forced from the interior cavity through the dispensing structure. A variety of configurations of combing tines, brushes, and nozzles are provided to accommodate varying hair types and textures as well as for the chosen width of the application of hair colorant.

5 Claims, 14 Drawing Sheets

HAIR COLOURING TOOL AND METHOD OF USE

CROSS REFERENCE TO RELATED APPLICATIONS

This application claims priority of U.S. Provisional Patent Application No. 61/329,815, filed Apr. 30, 2010, the contents of which are incorporated fully herein by reference.

FIELD OF THE INVENTION

The present invention relates to an improved tool and method of application of hair colourant to selected strands of hair that allows even colour distribution from the roots to the ends of the hair.

BACKGROUND OF THE INVENTION

Previous tools and methods for applying hair colourant include foil, silicone highlighting caps, colour combs, spatulas and colour boards. They proved to be time consuming for the user and the client. The silicone highlighting cap can also be uncomfortable for the client, as the user pulls strands of hair through a silicone cap with a metal hook. This method does not allow the user to place the colour to key areas of the hair. Other paint on techniques can apply too much or too little colourant. As a result, hair could be over coloured or colour is uneven.

SUMMARY OF THE INVENTION

According to the present invention there is provided a hair colouring tool which includes a body which has an opening and interior walls that define an interior cavity for containing a fluid hair colourant. At least one dispensing structure is provided on the body which is in fluid communication with the interior cavity. A plunger is pivotally connected to the body. The plunger is removably positioned in the opening of the interior cavity and in sealing engagement with the interior walls of the interior cavity such that upon manual depression of the plunger, fluid hair colourant is forced from the interior cavity through the dispensing structure. A variety of configurations and shapes of dispensing structure are provided to accommodate varying hair types and textures as well as for the desired width of the application of hair colourant. Dispensing structure can include various nozzles, and interchangeable plates that slide onto the bottom of the tool. A second opening is provided in the body which accommodates the plates. The plates have various colouring attachment which attach to the body. An O-ring or gasket is used on the body and on the plate to create a seal. The plates have several configurations to attain various colour applications.

DETAILED DESCRIPTION OF THE INVENTION

Figure 1:
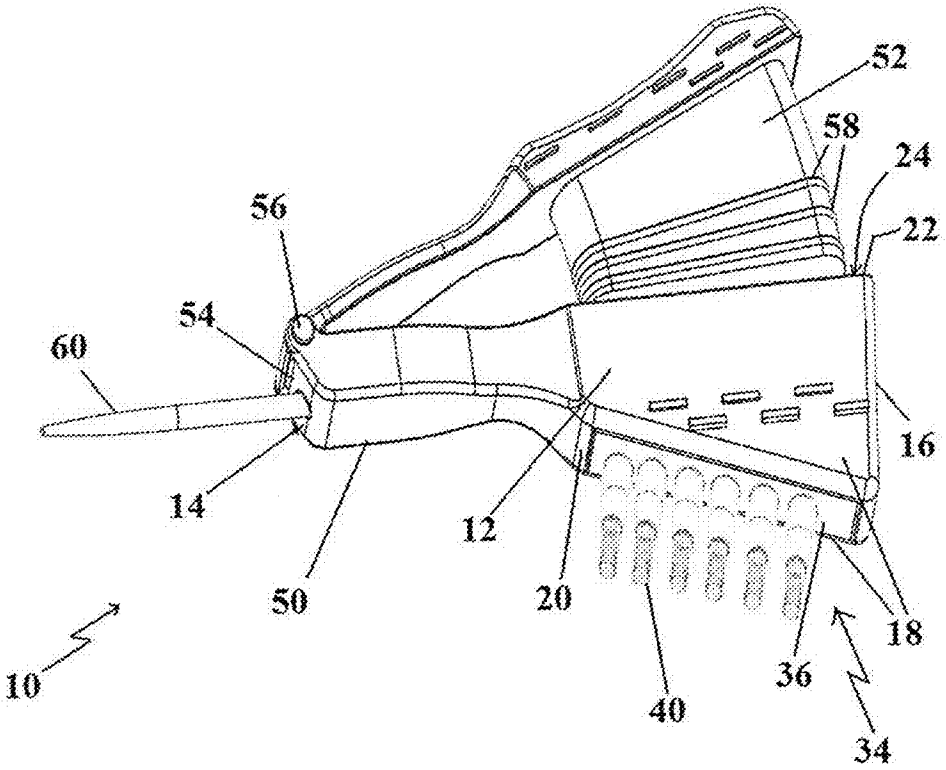
FIG. 1 is a perspective view of a hair colouring tool.

The preferred embodiment, a hair colouring tool generally identified by reference numeral 10, will now be described with reference to FIGS. 1 through 8. A second embodiment generally identified with reference numeral 100 will be described further on with reference to FIGS. 9 through 15.

Structure and Relationship of Parts

Figure 2:
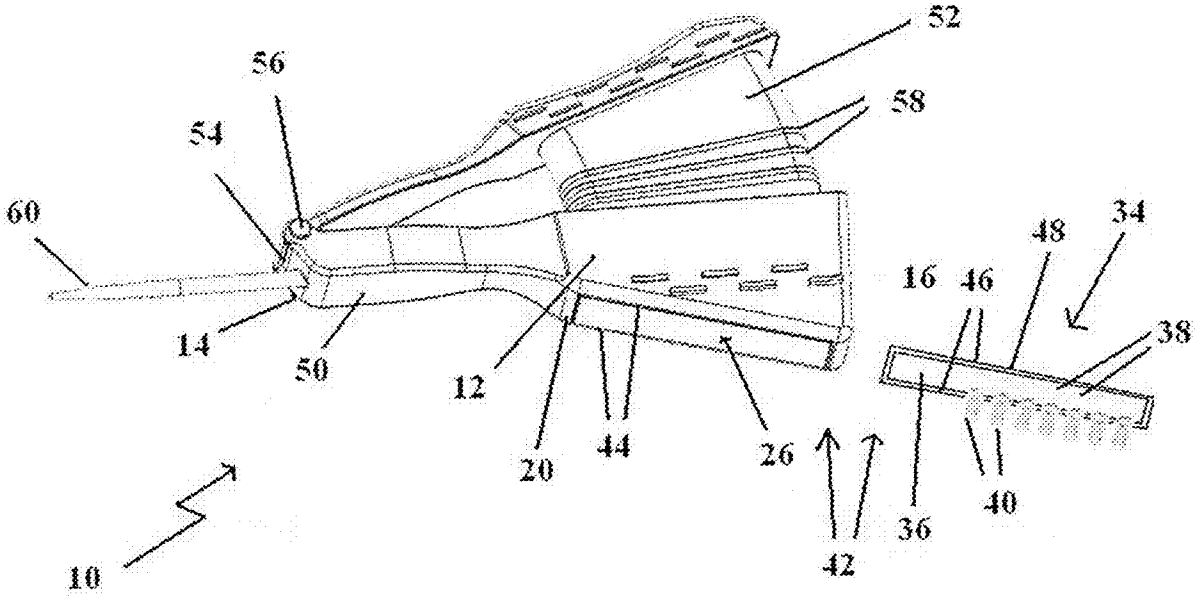
FIG. 2 is an exploded side elevation view of the hair colouring tool illustrated in FIG. 1.
Figure 3:
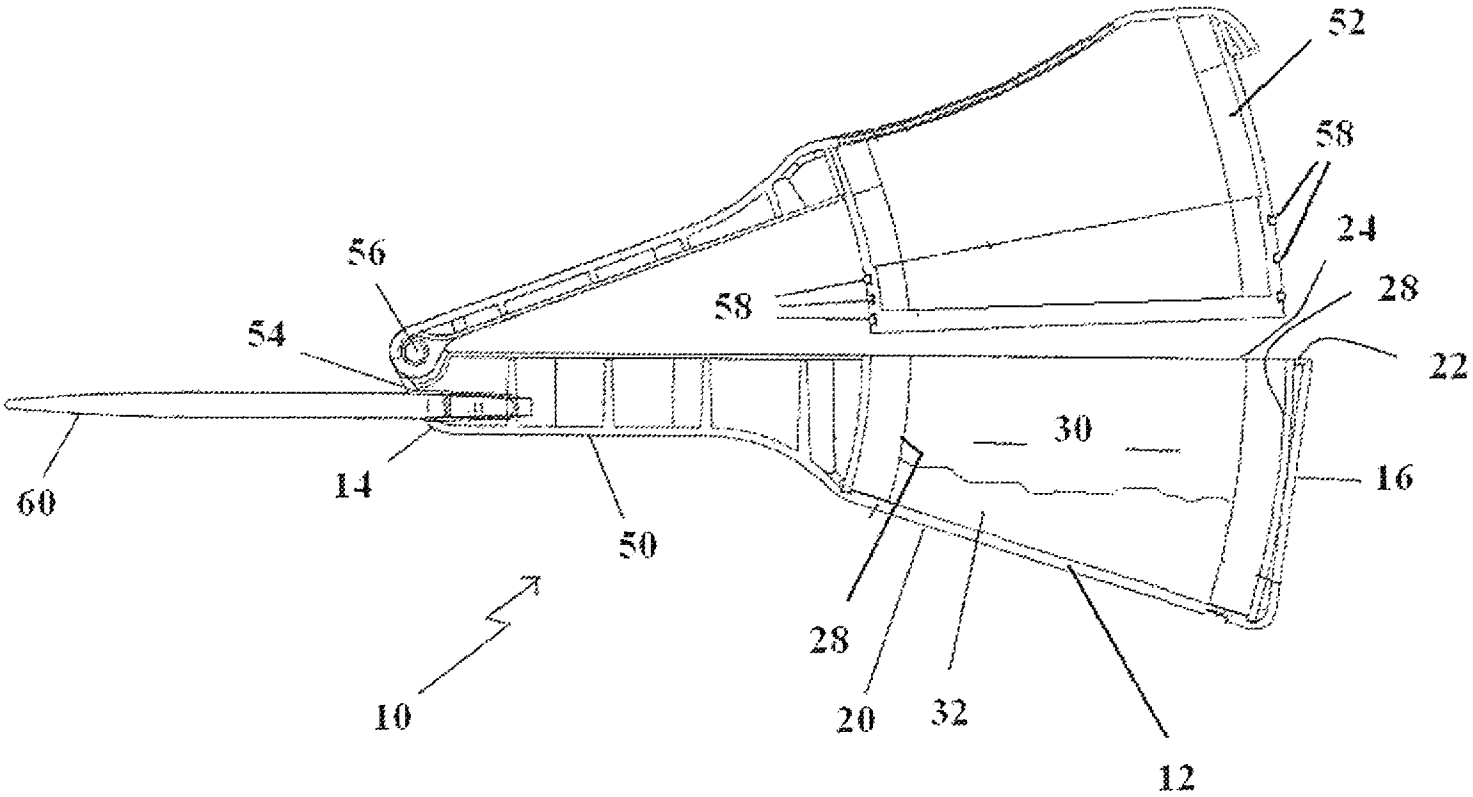
FIG. 3 is a side elevation view, in section, of the hair colouring tool.

Referring to FIG. 1, there is illustrated a hair colouring tool generally referenced by numeral 10. Flair colouring tool 10 has a body 12 with a first end 14, a second end 16 and opposed sides 18. Referring to FIG. 2, body 12 also has a bottom 20 and a top 22. A first opening 24 is provided in top 22 of body 12 and a second opening 26 is provided on bottom 20 of body 12. Referring to FIG. 3, interior peripheral walls 28 define an interior cavity 30 for containing a fluid hair colourant 32. Referring to FIG. 2, a dispensing structure 34 is provided in bottom 20 of body 12 which closes and seals second opening 26 in bottom 12 of body 12 as shown in. FIG. 1. Seals (not shown) can be used to ensure scaling engagement. Dispensing structure 34 is in fluid communication via a second opening 26 with interior cavity 30 of body 12 shown in FIG. 3. In the illustrated embodiment 10, dispensing structure 32 is a detachable from body 12 as illustrated in FIG. 2, however it will be appreciated that it could be permanently secured to body 12. Referring to FIG. 1, dispensing structure 34 includes a plate 36 with flow apertures 38 and combing tines 40. It will be appreciated that dispensing structure can have alternative configurations as will hereinafter be described. It will be appreciated that while combing tines 40 are shown as being in a single line, combing tines 40 could be in any number or configuration depending on the desired effect.

Referring to FIG. 2, an engagement mechanism generally referenced by numeral 42 is provided for detachably securing plate 36 to body 12. In the illustrated embodiment, engagement mechanism 42 includes at least first slide members 44 and second slide members 46. First slide members 44 are provided on bottom 20 of body 12 and second slide members 46 are provided on one of more of peripheral edges 48 of plate 36 such that second slide members 46 are telescopically and movably received by first slide members 44 in an axial direction on bottom 20 of body 12. It will be appreciated that there are also other types of engagement mechanisms 42 that could be used such as snap fit or friction fit mechanisms for securing plate 34 in sealing engagement over second opening 26.

Figure 4:
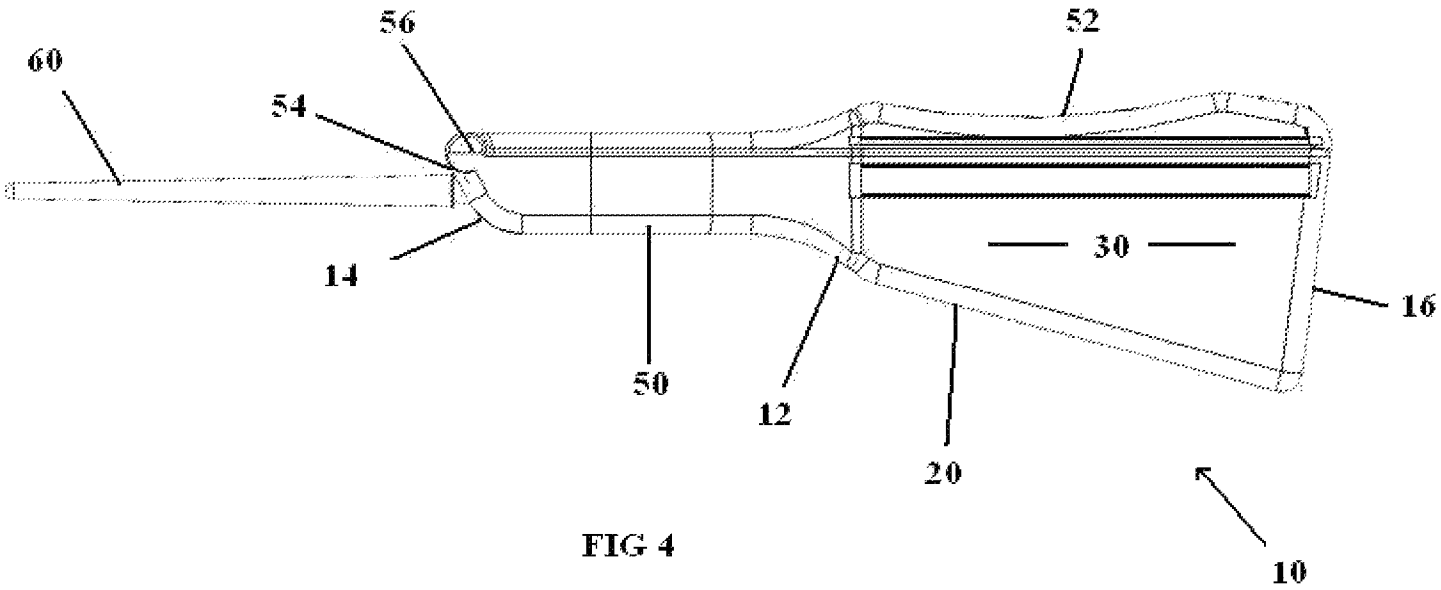
FIG. 4 is a side elevation view, in section, of the hair colouring tool with the plunger depressed.

Referring to FIG. 3, an elongate handle 50 is provided at first end 14 of body 12. A plunger 52 is pivotally connected to a remote end 54 of elongate handle 50 by a hinge 56. It will be appreciated that the illustrated embodiment shows hinge 56, but other mechanisms can be used to pivotally connect plunger 52 to body 12 such as a living hinge or other similar pivoting connection. Plunger 52 is removably positioned in first opening 24 of interior cavity 30 and is in sealing engagement with interior peripheral side walls 28 of interior cavity 30 such that upon manual depression of plunger 52, fluid hair colourant 32 is forced from interior cavity 30 through second opening 26 and flow apertures 38 on plate 36 of dispensing structure 34. One or more seals such as o-rings 58 can be used to ensure sufficient sealing engagement between plunger 52 and interior peripheral sidewalls 28 of interior cavity 30. It will be appreciated that while the illustrated embodiment shows o-rings 58, there are other types of sealing means that can be employed so long as plunger 52 is in sealing engagement with interior peripheral sidewalls 28 of interior cavity 30. Plunger 52 can be pivoted to disengage from first opening 24 and interior cavity 30 to allow for the placement of premixed hair colourant 32 into interior cavity 30. After hair colourant 32 is placed in interior cavity 30, plunger 52 can be pivoted back into position again in sealing engagement with first opening 24 and interior peripheral sidewalls 28 of interior cavity 30 as shown in FIG. 4. Manual pressure on plunger 52 depresses plunger 52 into interior cavity 30 to force hair colourant 32 out of interior cavity 30 though flow apertures 38.

Referring to FIG. 1, handle 50 can be provided with a detachable needle point attachment 60 for ease of use during the hair colouring process. Detachable needle point attachment 60 is for taking or separating sections of hair for colouring.

Referring again to FIG. 1, plates 36 can have differing shapes and configurations to adapt for hair type and texture or chosen result. Some of the other shapes will hereinafter be described, but the plate configurations are not limited to those described herein.

EXAMPLES OF DISPENSING STRUCTURES

Example 1

Figure 5:
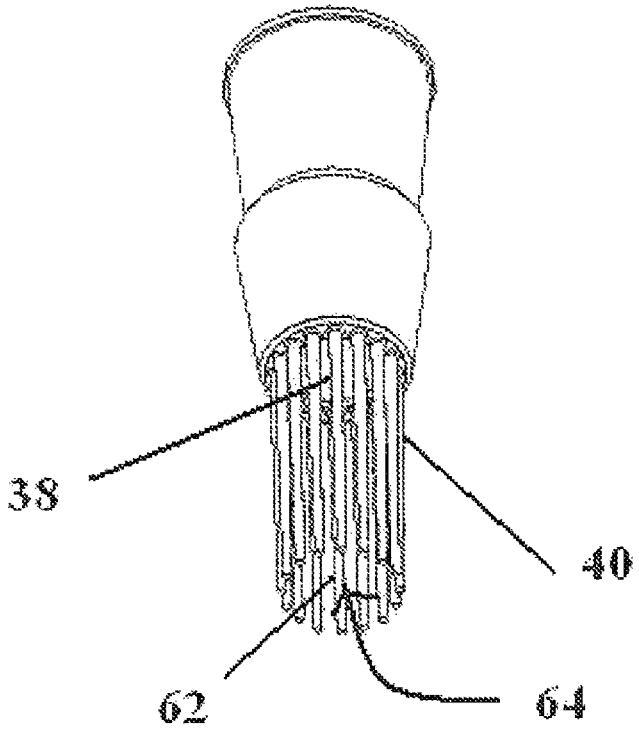
FIG. 5 is a perspective view of plate with combing tines in circular arrangement.
Figure 6:
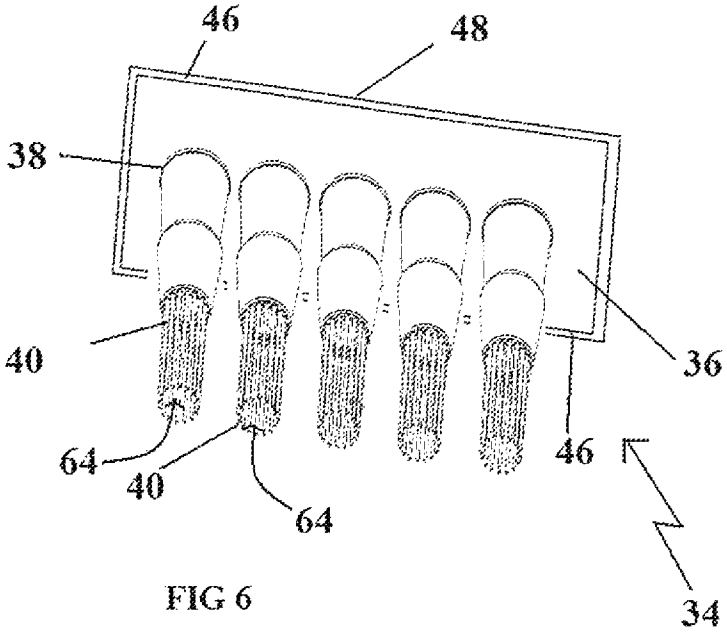
FIG. 6 is a perspective view of the hair coloring tool of FIG. 1, with a plate showing an alternative placement of combing tines.

Referring to FIGS. 2 and 6, there is illustrated dispensing structure 34 with plate 36 that has apertures 38 and combing tines 40. Combing tines 40 are arranged in a circular shape and are used to apply fluid hair colourant 32 to selected strands of hair. Referring to FIG. 5, in a center 62 of each circular arrangement of combing tines 40, there is a cavity 64 illustrated in FIG. 6. Referring to FIGS. 3 and 4, as the user depresses plunger 52, fluid hair colourant 32 is extruded through flow apertures 38 through plate 36 into the cavity 64, Referring to FIG. 5, due to the viscosity of fluid hair colourant 32, it remains suspended within cavity 64 of circular combing tines 40 until a user then combs through the hair, causing fluid hair colourant 32 to be applied to selected strands of hair.

In addition to the singular circular comb illustrated in FIG. 5, there can also be dispensing structure 34 with plate 36 that has numerous circular arrangements of combing tines 40, all in line adjacent to one another as illustrated in FIG. 1 and FIG. 6, so as to apply fluid hair colourant 32 illustrated in FIG. 3, to numerous strands of hair at the same time. While a circular shape arrangement of combing tines 40 is illustrated, it will be appreciated that other shapes can also work as well, including but not limited to square, diamond and rectangle arrangements of combing tines 40. In some cases some of tines 40 can be removed to create different widths of highlights to the hair.

Example 2

Figure 7:
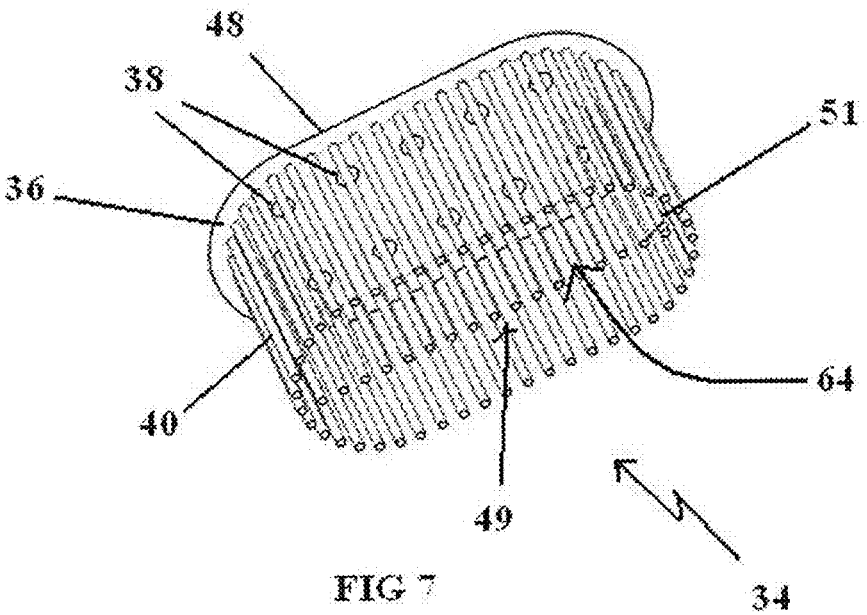
FIG. 7 is a detailed perspective view of plate illustrated in FIG. 6.

Referring to FIG. 7, dispensing structure 34 with plate 36 has several flow apertures 38. Combing tines 40 are arranged around peripheral edges 48 of plate 36. In a center 49 of plate 36 is a linear comb line 51. Referring to FIG. 7 and FIG. 3, combing tines 40 hold fluid hair colourant 32 in place due to its viscosity. As the user depresses plunger 52, fluid hair colourant 32 is extruded though apertures 38 in plate 36, This fills a cavity 64 that is defined by combing tines 40. The user then uses the tools to apply fluid hair colourant 32 to larger areas of the hair, making the application very quick. In addition to this dispensing structure 34, there are several other dispensing structure 34 having plates 36 using this concept, but the shapes of the arrangement of combing tines 40 differ. In addition to using fluid hair colourant 32, hair relaxer for afro-style hair can be used within the tool and applied using this dispensing structure.

Example 3

Figure 8:
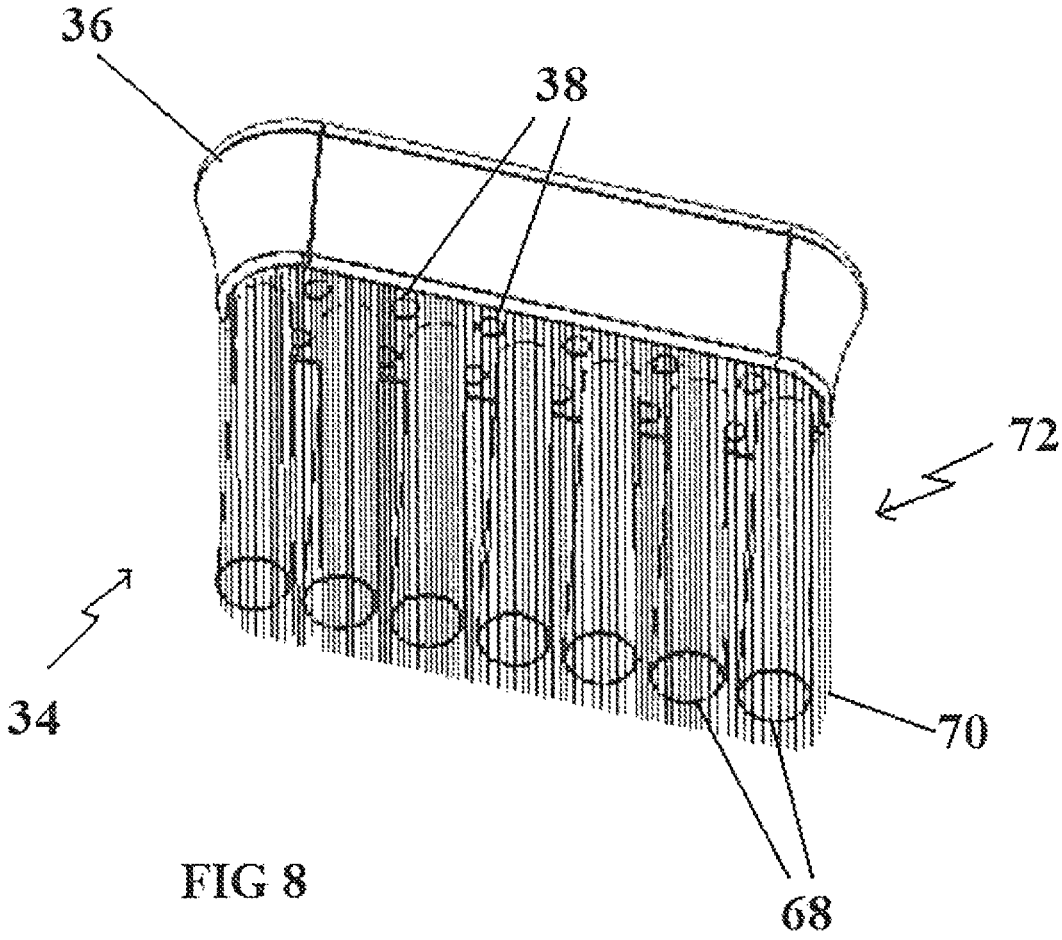
FIG. 8 is a detailed side elevation view of a series of dispensing nozzles on a plate.

Referring to FIG. 3 and FIG. 8, dispensing structure 34 has a plate 36 with nozzles 68 that are used to apply fluid hair colourant 32 directly to a root area of the hair. Plate 36 has flow apertures 38 that open into nozzles 68. Surrounding nozzles 68 are fine nylon fibers 70 that are affixed to plate 36 to create a brush like structure 72. As the user depresses plunger 52, fluid hair colourant 32 is extruded through flow apertures 38 and nozzles 68 onto nylon fibers 70. The user then paints fluid hair colourant 32 onto the hair.

Operation

The use and operation of hair colouring tool 10 will now be described with reference to FIGS. 1 through 8. Referring to FIG. 3, body 12 of hair colouring tool 10 has a unique internal cavity 28 that functions as a reservoir to contain a premixed liquid solution of hair colourant 32, which along with interchangeable dispensing structures 34 illustrated in FIG. 1 and FIG. 5 through 8 allows the user to apply a controlled amount of fluid hair colourant 32 to selected strands of hair quickly and evenly.

Referring to FIG. 1, essentially, the user selects any of available dispensing structures 34 to attach body 12, taking into consideration hair type and texture and desired result. Referring to FIG. 3, plunger 52 can be pivoted to disengage from first opening 24 and interior cavity 30 to allow for the insertion of premixed fluid hair colourant 32 to interior cavity 30. After hair colourant 32 is placed in interior cavity 30, plunger 52 is positioned again in first opening 24 and interior cavity 30. Plunger 52 is movable up and down within interior cavity 30. Referring to FIGS. 3 and 4, manual pressure on plunger 52 depresses plunger 52 deeper into interior cavity 30 to force fluid hair colourant 32 out of interior cavity 30 through dispensing structure 34 and flow apertures 38 illustrated in FIG. 2 for application to hair.

Referring to FIG. 1, the user will then take a section of hair that is to be partially coloured and guide dispensing structure 34 over that section of hair. Strands of hair being coloured will slide between combing tines 40 illustrated in FIG. 5 or nozzles 68 illustrated in FIG. 8 while collecting colour. Ideally, the section of hair is held out at the desired angle from the head of the person, and working from the root to the ends of the hair, the user guides dispensing structure 34 over the selected hair to be coloured at the roots and pulls hair colouring tool 10 towards themselves. This will create a line of colour that will be evenly applied to the length of the hair. Referring to FIG. 1, the user can add pressure by squeezing handle 50 and plunger 52 if they desire more fluid hair colourant 32 to be applied to the hair.

Referring to FIG. 1, after all of fluid hair colourant 32 has been applied, hair colouring tool 10 can be disassembled for easy cleaning and storage. Referring to FIG. 3, because fluid hair colourant 32 in interior cavity 30 is sealed, fluid hair colourant 32 is not exposed to the air, thus keeping an optimum strength. It cannot become contaminated nor tainted by air, or other potential constrainments, nor is there any risk of spillage. Fluid liquid hair colourant 32 is also isolated from hair that is not to be coloured, so that there is no risk of an uneven result.

Additional Information

Referring to FIG. 1, it is envisioned that hair colouring tool 10 is comprised of two injection molded plastic components comprising body 12 and plunger 52 that join together at the end of each component with hinge 56. Plunger 52, includes o-rings 58. The purpose of o-rings 58 is to create an effective seal so that no fluid hair colourant 32 or other liquid such as relaxant, can escape or become contaminated. Furthermore, it also makes the flow of fluid hair colourant 32 less sensitive by pressure. Referring to FIG. 3, body 12 contains interior cavity 30 in which a pre-mixed liquid such as fluid hair colourant 32 is added. Referring to FIG. 2, at bottom 20 of body 12, at least one first opening is provided 24. The purpose of first opening 24 is to enable the user to interchange dispensing structure 34 on body as desired. The user attaches dispensing structure 34 of choice depending on hair type and texture and desired result, to bottom 20 of body 12. Referring to FIG. 3, the user fills interior cavity 30 with pre-mixed fluid hair colourant 32, then manually depresses plunger 52 such that plunger is guided deeper into interior cavity 30. This creates a seal, so that fluid hair colourant 32 does not flow out of first opening 24 of interior cavity 30. The user then slightly squeezes handle 50 and plunger 52 by gripping it with their hand. This creates pressure, fluid hair colourant 32 is then forced through dispensing structure 34. The user will then take a section of hair that is to be partially coloured. The section is held out at the desired angle from the head, and working from the root to the ends of the hair, the user guides dispensing structure 34 over the selected hair to be coloured at the roots and pulls the unit towards themselves. This will create a line of colour that will be evenly applied to the hair. The user can add pressure by squeezing handle 50 and plunger 52 if they want more liquid to flow into dispensing structure 34, whilst applying the liquid to the hair.

Variations

Figure 9:
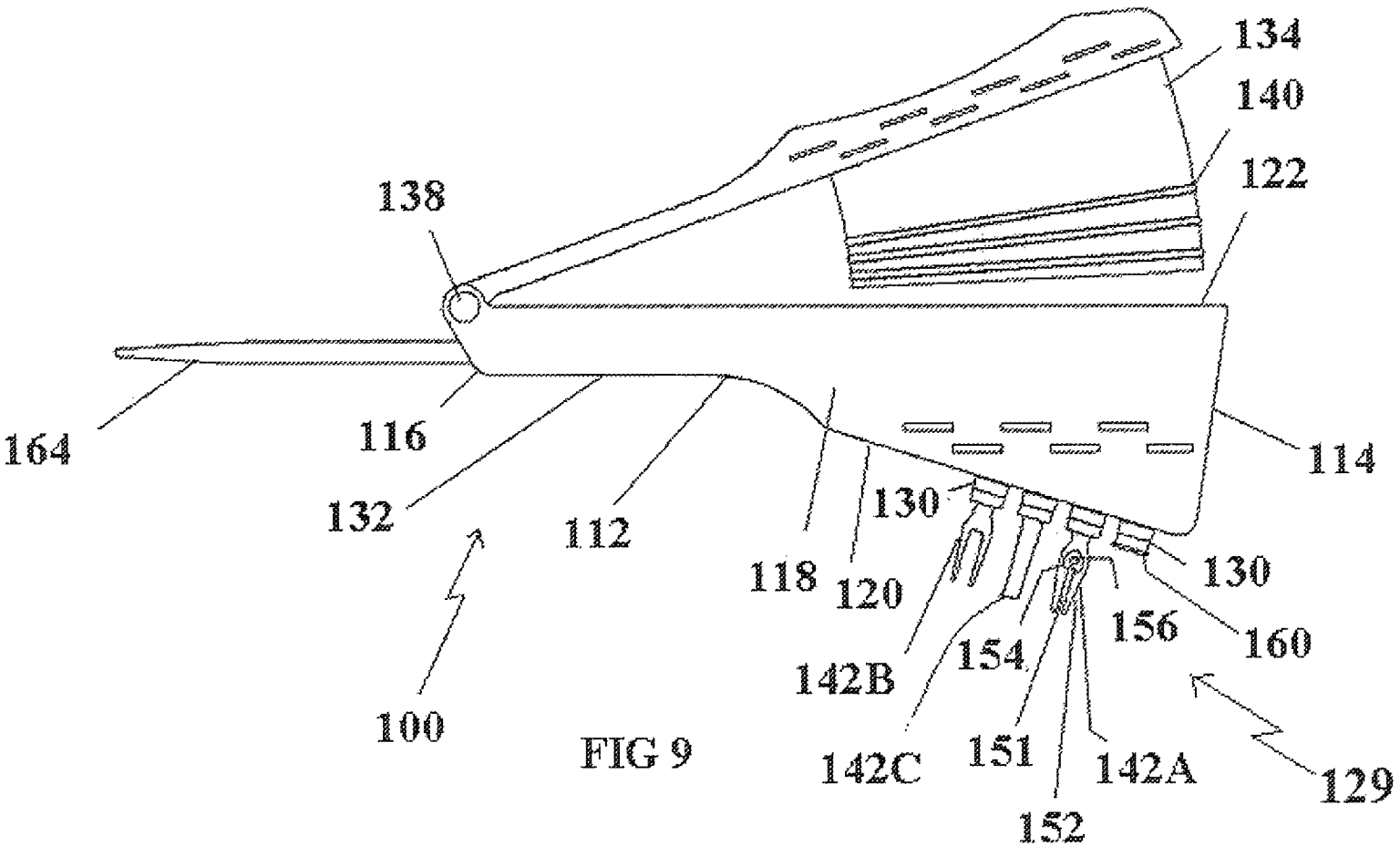
FIG. 9 is a side elevation view of a second embodiment of the hair colouring tool of the present invention.
Figure 10:
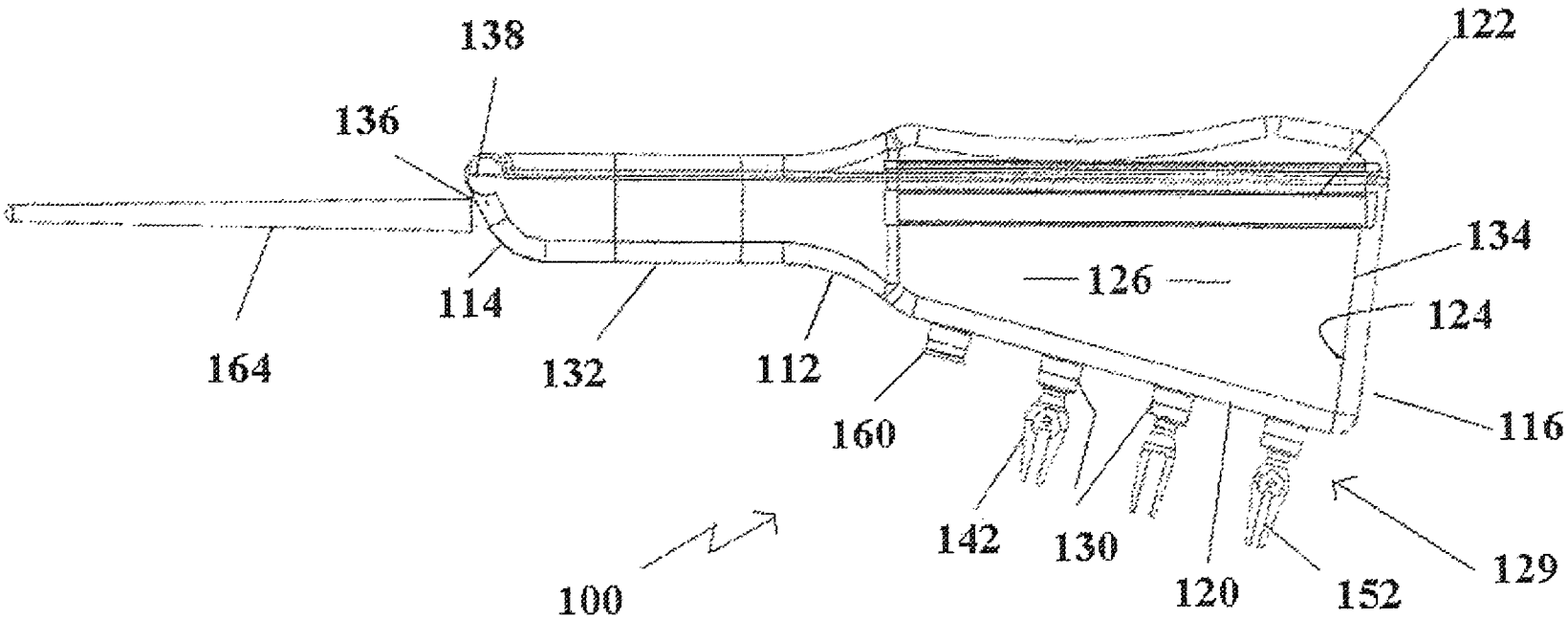
FIG. 10 is a side elevation view, in section, of the second embodiment of the hair colouring tool with the plunger depressed.
Figure 11:
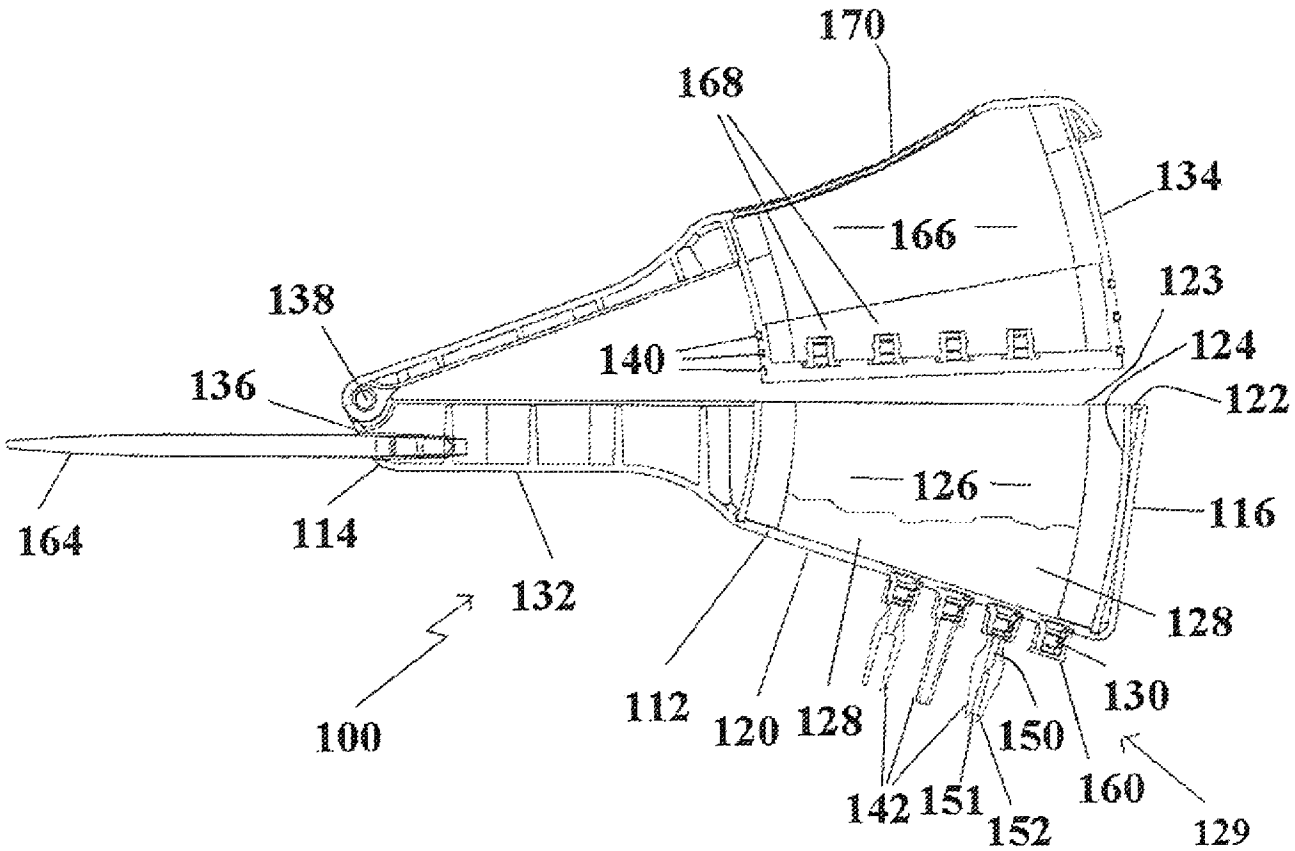
FIG. 11 is a side elevation view, in section, of the second embodiment of the hair colouring tool illustrated in FIG. 9.

Referring to FIG. 9 through 15, there is illustrated second embodiment of hair colouring tool generally referenced by numeral 100. Flair colouring tool 100 has a body 112 with a first end 114, a second end 116 and opposed sides 118. Referring to FIG. 10, body 112 also has a bottom 120 and a top 122. Referring to FIG. 11, an opening 123 is provided in top 122 of body 112. Interior walls 124 define an interior cavity 126 for containing a fluid hair colourant 128. A dispensing structure generally referenced by numeral 129 in the form of dispensing valves 130 are provided in bottom 120 of body 112. It will be appreciated that while four dispensing valves 130 are illustrated there could be fewer, such as one or two valves 130, or more than four valves 130. Dispensing valves 130 are in fluid communication with interior cavity 126 of body 112.

Referring to FIG. 11, an elongate handle 132 is provided at second end 116 of body 112. A plunger 134 is pivotally connected to a remote end 136 of elongate handle 132 by a hinge 138. It will be appreciated that the illustrated embodiment shows hinge 138, but other mechanisms can be used to pivotally connect plunger 134 to body 112 such as a living hinge or other such connection. Plunger 134 is removably positioned in opening 123 of interior cavity 126 and is in sealing engagement with interior walls 124 of interior cavity 126 such that upon manual depression, of plunger 134, fluid hair colourant 128 is forced from interior cavity 126 through dispensing valves 130. One or more seals such as o-rings 140 can be used to ensure sufficient sealing between plunger 134 and interior walls 124 of interior cavity 126. It will be appreciated that while the illustrated second embodiment 100 shows o-rings 140, there are other types of sealing means that can be employed so long as plunger 134 is in secured sealing engagement with the interior walls 124. Plunger 134 can be pivoted to disengage from opening 123 and interior cavity 126 to allow for the placement of premixed hair colourant 128 to interior cavity 126. After hair colourant 128 is placed in interior cavity 126, plunger 134 is positioned again in opening 123 and interior cavity 126. Plunger 134 is movable up and down within interior cavity 126. Manual pressure on plunger 134 depresses plunger 134 downward into interior cavity 126 to force hair colourant 128 out of interior cavity 126 though dispensing valves 130.

Referring to FIG. 11, nozzles 142 can be secured to any number of dispensing valves 130. Nozzles 142 are be removable and interchangeable depending on the colouring application. Nozzles 142 be of varying shapes, configurations and sizes.

Figure 12:
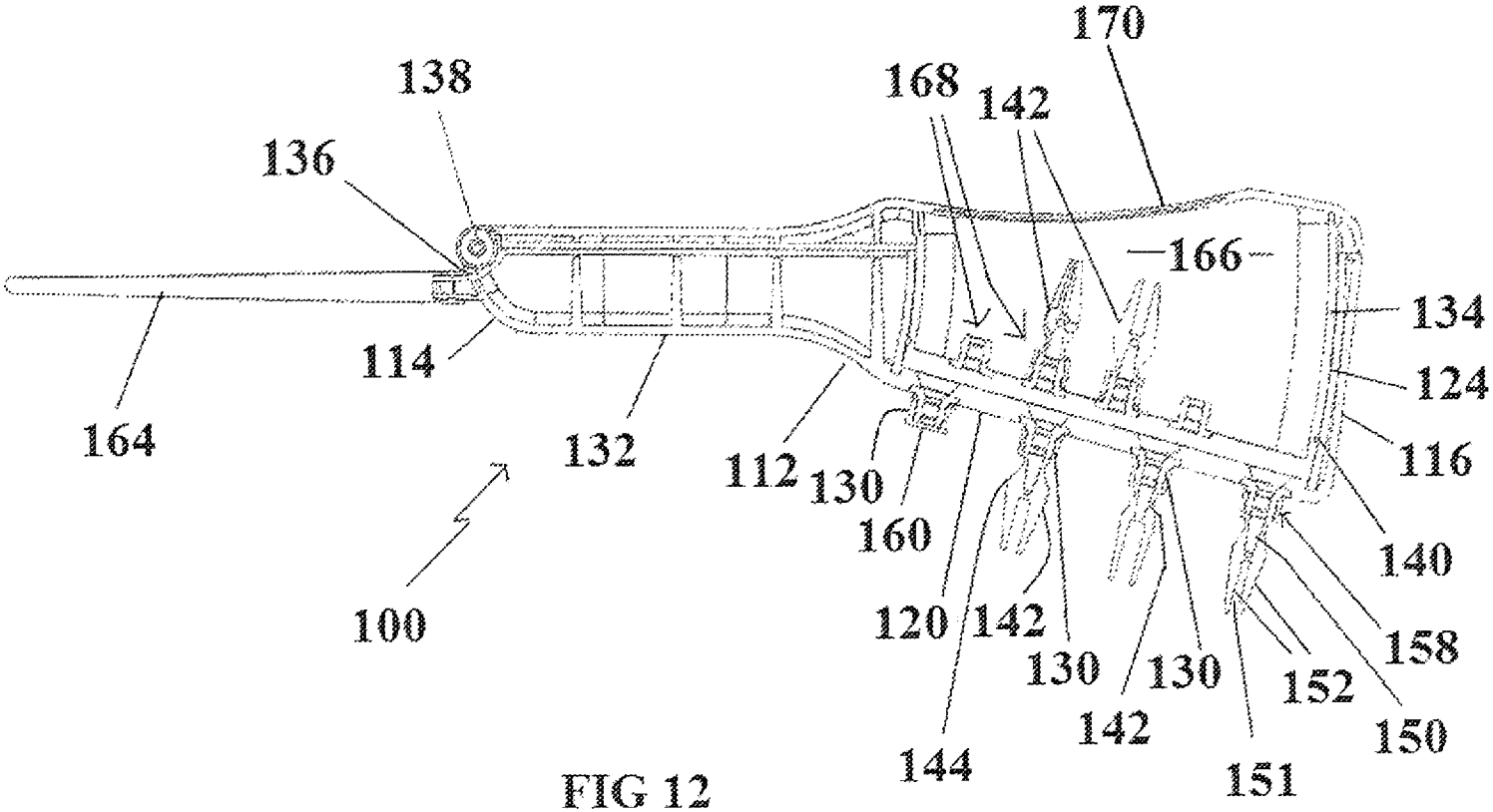
FIG. 12 is a side elevation view, in section, of the second embodiment of the hair colouring tool of FIG. 10 with the nozzles stored in a storage cavity.
Figure 13:
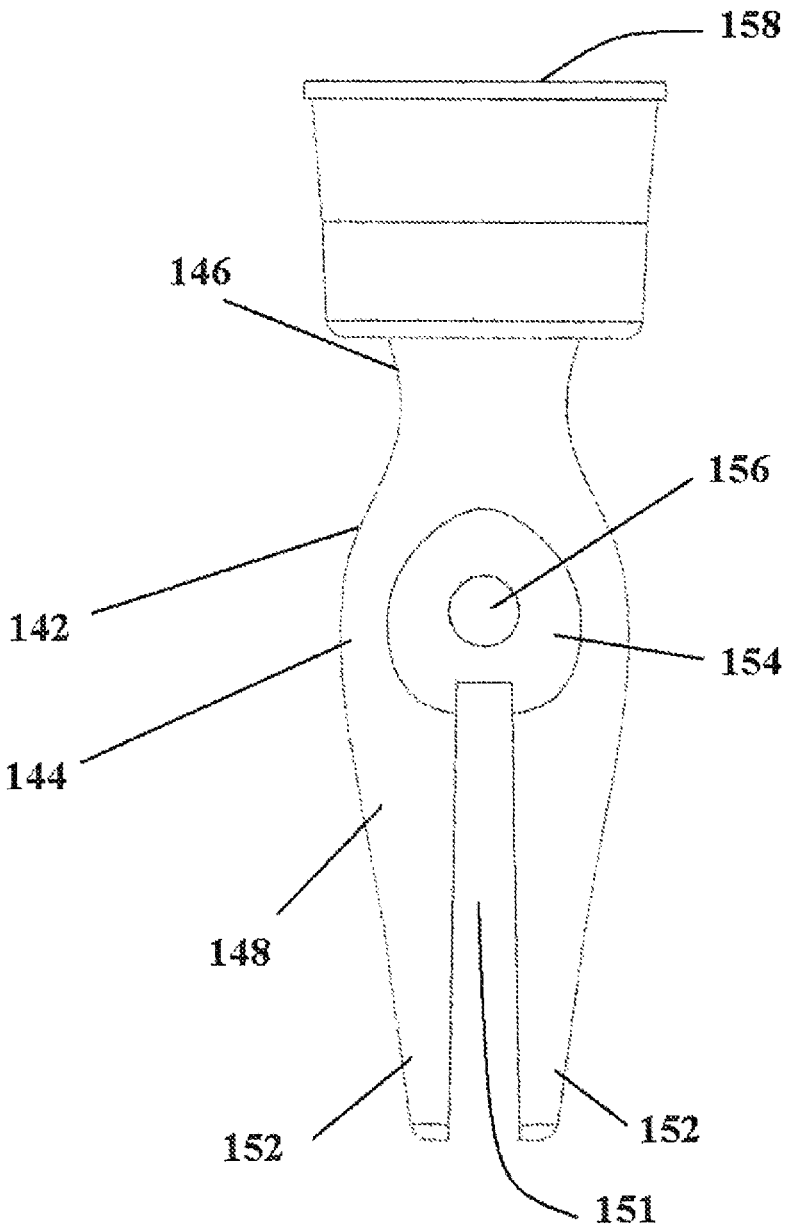
FIG. 13 is a detailed view of a nozzle of the second embodiment of the hair colouring tool.

Referring FIG. 13, there is illustrated one type of nozzle 142, which has a nozzle body 144 with a first end 146 and a second end 148 and a central bore 150 extending through nozzle body 144. Two combing tines 152 are provided at second end 148. A tear drop shaped dispensing indentation 154 with a nozzle aperture 156 in fluid communication with central bore 150 is provided on nozzle body 144 above two combing tines 152 as illustrated in FIGS. 11 and 12. Colourant 128 flows from interior cavity 126 through valve 130 into nozzle 142 down bore hole 150 and out through nozzle aperture 156 into dispensing indentation 154 which collects dispensed colourant 128 for application to hair. A snap-in connection generally referenced by numeral 158 is provided at first end 146 for connecting nozzle 142 to valve 130 on body 112 illustrated in FIG. 9. Alternative means can be used for securing nozzle 142 to valve 130 such as mating threads, twist locks, or other securing means for detachably securing nozzle 142 to valve 130. Referring to FIGS. 11 and 13, combing tines 152 on different nozzles 142 can be spaced apart as different widths. Nozzles 142 having tines 152 spaced further apart will dispense a wider width of colourant 128 on hair while those with tines 152 spaced closer together will dispensing a thinner line of colourant 128 on hair. A user can choose to use up to four nozzles 142 depending on hair type and texture and chosen result. For example, four of the same type of nozzle 142 will create four lines of colour being all identical to one another. In the alternative, alternating or differing nozzles 142 can be used to create a different line width formations of colour. If only three or fewer of the four valves 130 are being used during a particular application, plugs 160 can be placed over remaining valves 130 to close off unintended flow of hair colourant 128.

Nozzles 142 can have differing shapes and configurations to adapt for hair type and texture or chosen result. Some of the other shapes will hereinafter be described, but the nozzle designs are not limited to those shapes.

By way of example, referring to FIG. 9, nozzle 142A has a nozzle body 144 with a first end 146 and a second end 148 and a central bore 150 extending through nozzle body 144. Two combing tines 152 are provided at second end 148. A tear drop shaped dispensing indentation 154 with an nozzle aperture 156 in fluid communication with central bore 150 is provided on nozzle body 144 above two combing tines 152. Snap-in connection 158 is provided at first end 146 for connecting nozzle 142 to valve 130 on body 112 is cylindrical and attaches to bottom 120 of body 112. There are two further nozzles 42B and 42C which are identical in shape to 42A but differ in that is t two combing tines 152 of each are 1 mm wider in each case.

Figure 14:
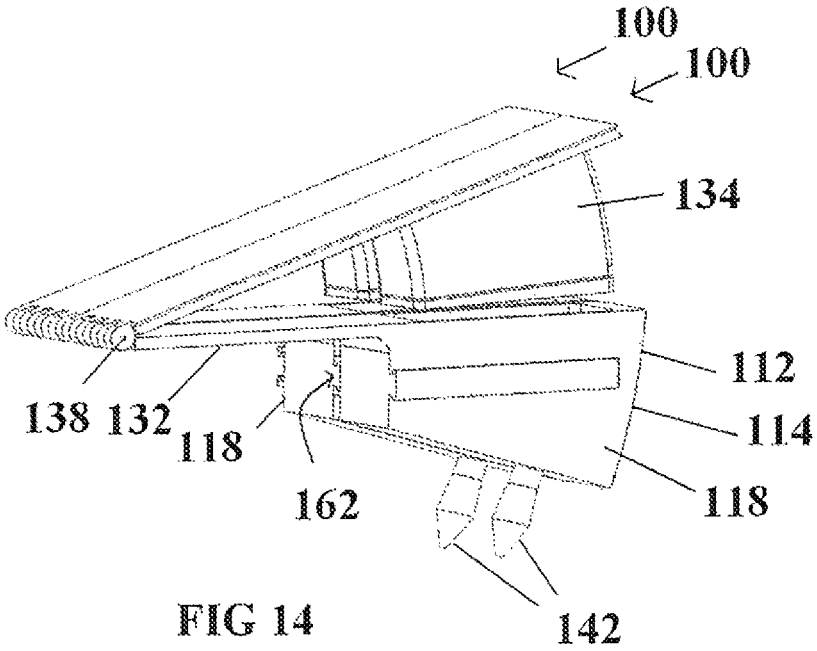
FIG. 14 is perspective view of the second embodiment of the hair colouring tool secured to an adjacent tool.

Referring to FIG. 14, the two or more hair colouring tools 100 may be connected adjacent to each other to allow the user to apply two or more different colours to the hair at the same time. Hair colouring tools 100 can be connected to each other by means of sliding tracks generally referenced as numeral 162 as illustrated or in the alternative other suitable means for detachably securing two or more hair colouring tools 100 together. It is preferable that adjacent plungers 134 also be connected as illustrated to ensure even application of hair colour.

Figure 15:
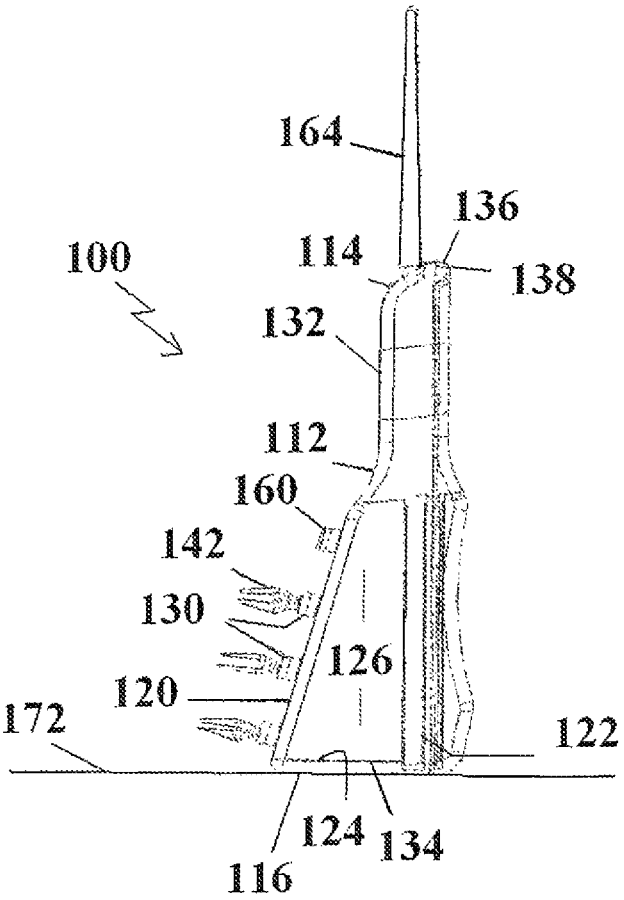
FIG. 15 is a side elevation view of the tool standing on end.

Referring to FIG. 15, first end 114 of body 112 can be planer such that whilst hair colouring tool 100 is not in use during the colour process, the user can stand hair colouring tool 100 vertically on its first end 114 on an underlying surface 172. This can stop hair colourant 128 from flowing out of nozzle 142 when not in use. First embodiment 10 illustrated in FIG. 1, can stand on end in the same manner.

Referring to FIG. 11, handle 132 can be provided with a detachable needle point attachment 164 for ease of use during the hair colouring process. Detachable needle point attachment 164 is for taking or separating sections of hair for colouring.

Referring again to FIG. 11, plunger 134 can contain a storage cavity 166 for storing detachable nozzles 142 and plugs 160. Securing means such as a twist lock connector generally referenced by numeral 168 can be provided for securing nozzles 142 in position within storage cavity 166. This prevents nozzles 142 and plugs 160 which aren't being used from becoming lost or damaged during use of tool 100, or even when tool 100 is not in use.

Second embodiment 100 illustrated in FIG. 9 through 15 operates in the same manner as first embodiment 10 illustrated in FIG. 1.

Cautionary Warnings:

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

What is claimed is:

1. A hair colouring tool comprising;

a body having a first opening and interior walls defining an interior cavity for containing a fluid hair colourant;

at least one dispensing structure being provided on the body in fluid communication with the interior cavity, the at least one dispensing structure including a length and a detachable elongate plate which is at least a third of the length of the dispensing structure;

at least one flow aperture being positioned on the elongate plate;

an engagement mechanism is provided for detachably securing the elongate plate of the at least one dispensing structure to the body;

a plunger pivotally connected to the body and removably positioned in the first opening of the interior cavity, the plunger having a volume substantially equal to the interior cavity; and a plurality of o-rings provided spaced along the plunger to provide sealing engagement with the interior walls of the interior cavity such that upon depression of the plunger, fluid hair colourant is forced from the interior cavity through the at least one dispensing structure.

2. The hair coloring tool of claim 1 wherein the engagement mechanism includes at least first slide members on the body and second slide members on the at least one dispensing structure such that second slide members are received by first slide members in an axial direction.

3. The hair colouring tool of claim 1 wherein the elongate plate includes a plurality of combing tines.

4. The hair colouring tool of claim 1 wherein the at least one dispensing structure includes a plate with having at least one flow aperture and a plurality of flow nozzles arranged along a longitudinal axis of the elongate plate.

5. The hair colouring tool of claim 1 wherein the elongate plate, includes one flow nozzle.

* * * * *